US007360332B2

(12) United States Patent
Rozovsky

(10) Patent No.: US 7,360,332 B2
(45) Date of Patent: Apr. 22, 2008

(54) FIREARM TRIGGER PROXIMITY ALARM

(76) Inventor: Joshua I. Rozovsky, 272 Duncaster Rd., Bloomfield, CT (US) 06002-1105

( * ) Notice: Subject to any disclaimer, the term of this patent is extended or adjusted under 35 U.S.C. 154(b) by 127 days.

(21) Appl. No.: 11/421,751

(22) Filed: Jun. 1, 2006

(65) Prior Publication Data

US 2008/0060246 A1 Mar. 13, 2008

(51) Int. Cl.
*F41A 17/06* (2006.01)
*F41A 35/00* (2006.01)

(52) U.S. Cl. ..... 42/70.07; 42/70.01; 42/106

(58) Field of Classification Search ..... 42/70.01, 42/70.07, 69.01
See application file for complete search history.

(56) References Cited

U.S. PATENT DOCUMENTS 4,476,644 A * 10/1984 Laing ..... 42/70.01
4,829,692 A 5/1989 Guild
5,465,518 A 11/1995 Blaser
5,508,683 A 4/1996 Hall
5,560,135 A 10/1996 Ciluffo
5,715,623 A 2/1998 Mackey, III
6,293,039 B1 * 9/2001 Fuchs ..... 42/70.11
6,297,844 B1 10/2001 Schatz et al.
6,305,941 B1 * 10/2001 Kotsiopoulos et al. ..... 434/11
6,415,539 B1 * 7/2002 Fuchs et al. ..... 42/70.07
6,429,769 B1 8/2002 Fulgueira
6,481,138 B1 * 11/2002 Roca et al. ..... 42/70.07
6,481,140 B1 * 11/2002 Marshall ..... 42/70.11
6,499,243 B1 * 12/2002 Herzog ..... 42/70.07
6,563,940 B2 * 5/2003 Recce ..... 382/120
6,568,116 B2 * 5/2003 Hathaway ..... 42/70.11
6,718,679 B2 * 4/2004 Herzog ..... 42/70.07
6,775,940 B2 8/2004 Dworzan et al.
6,785,995 B2 * 9/2004 Herzog et al. ..... 42/70.07
6,802,147 B2 10/2004 Haefeli et al.
6,862,829 B2 3/2005 McMoore
7,030,729 B2 * 4/2006 Albanesi et al. ..... 340/5.61
2002/0174588 A1 11/2002 Danner et al.
2003/0041497 A1 * 3/2003 Midgley ..... 42/70.01
2003/0163941 A1 * 9/2003 Herzog ..... 42/70.07
2003/0163942 A1 * 9/2003 Herzog et al. ..... 42/70.07
2005/0262751 A1 * 12/2005 Leslie ..... 42/70.01

* cited by examiner

*Primary Examiner*—Bret Hayes
(74) *Attorney, Agent, or Firm*—QuickPatent, Inc.; Kevin Prince

(57) ABSTRACT

A proximity alarm for a firearm having a trigger and a trigger guard is disclosed. The proximity alarm is for detecting when an object, such as a user's finger, enters the space between the trigger and the trigger guard, whereupon the proximity alarm alerts the user and any surround individuals that the object is in a position to depress the trigger to fire the firearm. An embodiment for mounting the proximity alarm onto an existing firearm is disclosed, as well as another embodiment wherein the proximity alarm is incorporated into the firearm itself to form a total firearm safety system. In the first embodiment, the proximity alarm includes an enclosure mounted proximate to the trigger guard of the firearm. The enclosure includes a firearm mounting means and at least one proximity sensor cooperating in such a way that an included proximity sensor is positioned to detect the object entering between the trigger and the trigger guard. The proximity alarm further includes an alarm circuit electrically connected to the proximity sensor and housed in the enclosure or, in the embodiment wherein the proximity alarm is incorporated into the firearm, within the firearm itself. The alarm circuit includes a power source, such as a battery, and an alarm means, such as an audio alarm, a visual alarm, or a tactile alarm. The alarm means may further include a wireless transmitter that transmits an alarm signal to a remote alarm unit for remote monitoring of the firearm.

17 Claims, 4 Drawing Sheets

FIREARM TRIGGER PROXIMITY ALARM

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to firearm safety devices, and more particularly to a Firearm Trigger Proximity Alarm.

DISCUSSION OF RELATED ART

Firearm accidents can be particularly devastating, and therefore much effort has been put forth on firearm safety devices. Nearly all self-loading firearms, for example, have a safety lock mechanism that prevents the firearm's trigger from being depressed unless the safety is in an off position. Clearly one drawback of relying on such a safety mechanism alone is that the user of the firearm might forget which position the safety is in, and thus be either unable to fire the weapon when it is necessary due to inadvertently leaving the safety in its "on" position, or accidentally discharging the firearm while believing that the safety was on while it was actually off.

Several devices have been designed to alert the user while the safety in a firearm is in the off position. For example, U.S. Pat. No. 4,829,692 to Guild on May 16, 1989, teaches such a device, as does U.S. Pat. No. 5,465,518 to Blaser on Nov. 14, 1995. Such devices are well suited for alerting the gun user and individuals nearby that the gun's safety is in the off position and that therefore the gun is in a ready-to-fire state. However, such devices do not indicate that the user of the gun is about ready to shoot. Indeed, until the user is ready to shoot it is common practice that the user's trigger finger remains in front of the gun's trigger guard. Knowing that the gun's safety is off is not nearly as vital as knowing that the user's finger is on the trigger and in a position to fire.

Other types of firearm safety devices serve to warn users and bystanders that a gun is in a raised position, often indicative of impending use thereof. U.S. Pat. Nos. 6,775,940 to Dworzan et al. on Aug. 17, 2004; 5,508,683 to Hall on Apr. 16, 1996; 5,715,623 to Mackey, III, on Feb. 10, 1998; and US Patent Application 2002/0174588 to Danner et al. on Nov. 28, 2002 all teach firearm safety devices that include some form of motion sensing device and an associated alarm to warn of a gun being raised into a firing position or to prevent a gun from discharging in the event of sudden motion of the gun or jarring thereof. But there are many situations where the raising of the gun barrel may occur without the intent to fire the weapon. For example, when military troops are traversing obstacles or when law enforcement personnel are jumping over a fence, or the like, a gun may become elevated in normal course. At such times a gun alarm does not accurately signal the intent of the gun user. Thus, the elevation of the gun barrel is not always the best indicator as to the intent of the user.

Other firearm status sensing devices are known in the art, such as that taught in U.S. Pat. No. 6,802,147 to Haefeli et al. on Oct. 12, 2004. Such a device is a system for sensing the state of spaces within the firearm for computerized or automated control, and is limited to internal spaces such as the gun barrel and firing chambers. This type of device is best suited for large caliber weapons such as cannons, tank weapons, and the like.

Firearm safety relies on a series of rules that, when followed, will avoid injury to the firearm user and others. One of the most important of these rules is that the gun operator keep his fingers and other objects outside of the trigger guard until he is ready to fire. Unfortunately, in stressful combat situations or during intensive training simulations, even experienced shooters may fail in this regard as a result of poor training, negligence, or loss of fine motor control. In training new shooters, instructors may fail to adequately monitor the shooters under their instruction in time to warn the novice to remove their finger from the trigger area.

Gunmakers, such as Glock and Savage, have used a "Safe Action System" or a "Accu-trigger System" to ensure that the trigger cannot move unless the operator pulls a lever, which is essentially a second trigger, mounted into the first trigger. This type of system reduces the chance of a sideways or angled intrusion into the trigger guard causing the firearm to discharge.

U.S. Pat. No. 6,862,829 to McMoore on Mar. 8, 2005 teaches a tactile indicator that the operator's finger is outside of the trigger guard, in hopes that the operator, not feeling this tactile indicator, will realize that his finger may be located dangerously close to the trigger. Such a device, however, relies heavily on the operator realizing his finger is not in a safe position, and does not actively indicate or alert the operator that his finger may be in an unsafe position.

No prior art device exists for detecting when a person's finger enters the space adjacent a weapon's trigger between the trigger and the trigger guard. Such a device would alert the user, who may be unaware of his finger positioning, particularly in an intense situation, and also alert bystanders who can judge a more proper course of action knowing that the gun user's finger has been positioned on the gun's trigger.

There are proximity sensors for detecting hand or finger position within a machine operating area, such as the well-known safety curtain devices exemplified by U.S. Pat. No. 6,297,844 to Schatz et al on Oct. 2, 2001. Such devices are well-suited for preventing accidents by shutting down machinery when a user's hand enters a dangerous area. However, such devices are not well-suited for use with or mounting on a firearm. U.S. Pat. No. 6,429,769 to Fulgueira on Aug. 6, 2002 teaches a firearm device that includes a wireless radio link to an electronic receptor that takes an action in response to the firearm being discharged, such as by calling emergency services personnel, or the like. Such a device does nothing, however, before the weapon is discharged and thus may not be able to warn of improper finger positioning on the weapon until too late.

Therefore, there is a need for a firearm-mounted proximity alarm that warns both the user of the firearm and bystanders that the user's finger has been moved into position adjacent to the trigger and that the weapon is therefore ready to be fired. Such a needed device would not interfere with the firing of the weapon when desired, and would be either mountable on existing firearms or made integral therewith. Such a needed device would provide a variety of alarm means as necessary for any particular type of weapon or situation, and would be durable and relatively inexpensive to manufacture. The present invention accomplishes these objectives.

SUMMARY OF THE INVENTION

The present device is a proximity alarm for a firearm having a trigger and a trigger guard. The proximity alarm is for detecting when an object, such as a user's finger, enters the space between the trigger and the trigger guard, whereupon the proximity alarm alerts the user and any surrounding individuals that the object is in a position to depress the trigger to fire the firearm.

Two preferred main embodiments of the invention are disclosed herein, an embodiment for mounting the proximity alarm onto an existing firearm, and another embodiment wherein the proximity alarm is incorporated into the firearm itself to form a total firearm safety system. In the first embodiment, the proximity alarm includes an enclosure mounted proximate to the trigger guard of the firearm. The enclosure includes a firearm mounting means and at least one proximity sensor cooperating in such a way that the at least one proximity sensor is positioned to detect the object entering between the trigger and the trigger guard. Such a proximity sensor may be an optical sensor, an electrical capacitive sensor, a mechanical switch, or the like.

The proximity alarm further includes an alarm circuit electrically connected to the at least one proximity sensor and housed in the enclosure or, in the embodiment wherein the proximity alarm is incorporated into the firearm, within the firearm itself, such as within a grip or frame of the firearm. The alarm circuit includes a power source, such as a battery, and an alarm means, such as an audio alarm, a visual alarm, or a tactile alarm. The alarm means may further include a wireless transmitter that transmits an alarm signal to a remote alarm unit for remote monitoring of the firearm.

The present invention is a firearm-mounted proximity alarm that warns both the user of the firearm and bystanders that the user's finger has been moved into position adjacent to the trigger and that the weapon is therefore ready to be fired. The present device does not interfere with the normal firing of the weapon when such is desired, and can be either mountable on existing firearms or made integral therewith. The present invention provides a variety of alarm means as necessary for any particular type of weapon or situation, and is durable and relatively inexpensive to manufacture. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
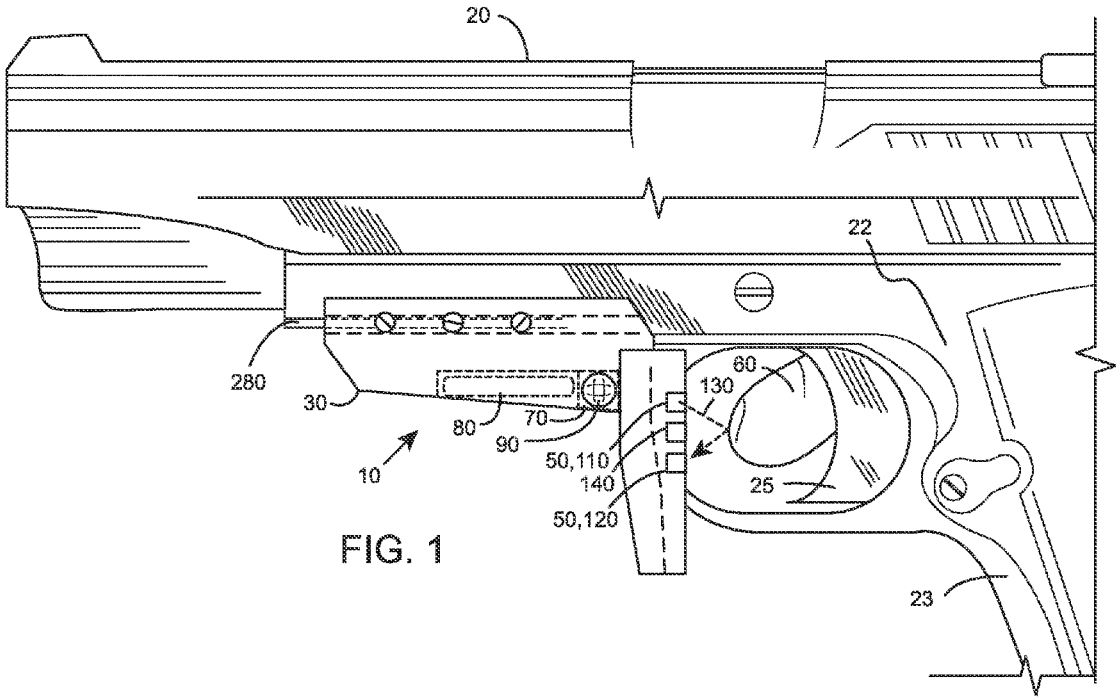
FIG. 1 is a partial left-side elevational view of a firearm and a proximity alarm of the present invention, illustrating an embodiment wherein the proximity alarm is mounted to an accessory rail of the firearm.
Figure 2:
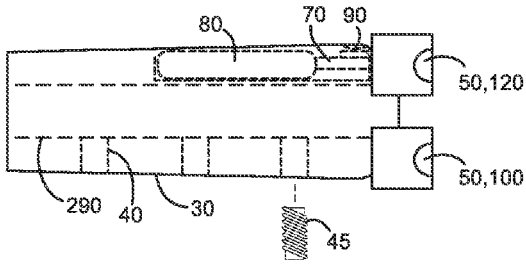
FIG. 2 is a top plan view of the proximity alarm of the embodiment of the invention as illustrated in FIG. 1.

FIGS. 1 and 2 illustrate a proximity alarm 10 for a firearm 20 that has a trigger 25 and a trigger guard 26. The proximity alarm 10 is for detecting when an object 60, such as a user's finger, enters the space between the trigger 25 and the trigger guard 26, whereupon the proximity alarm 10 alerts the user and any surrounding individuals that the object 60 is ready to depress the trigger 25 to fire the firearm 20.

Figure 3:
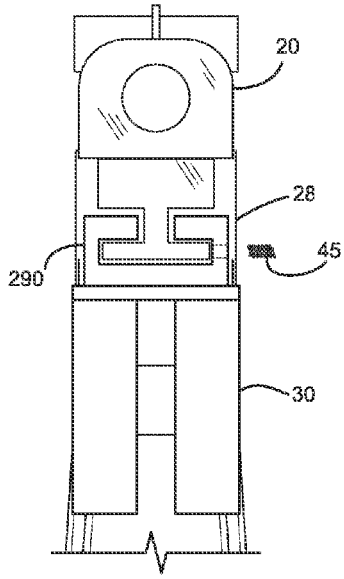
FIG. 3 is a front elevational view of the proximity alarm of the embodiment of the invention as illustrated in FIG. 1.
Figure 4:
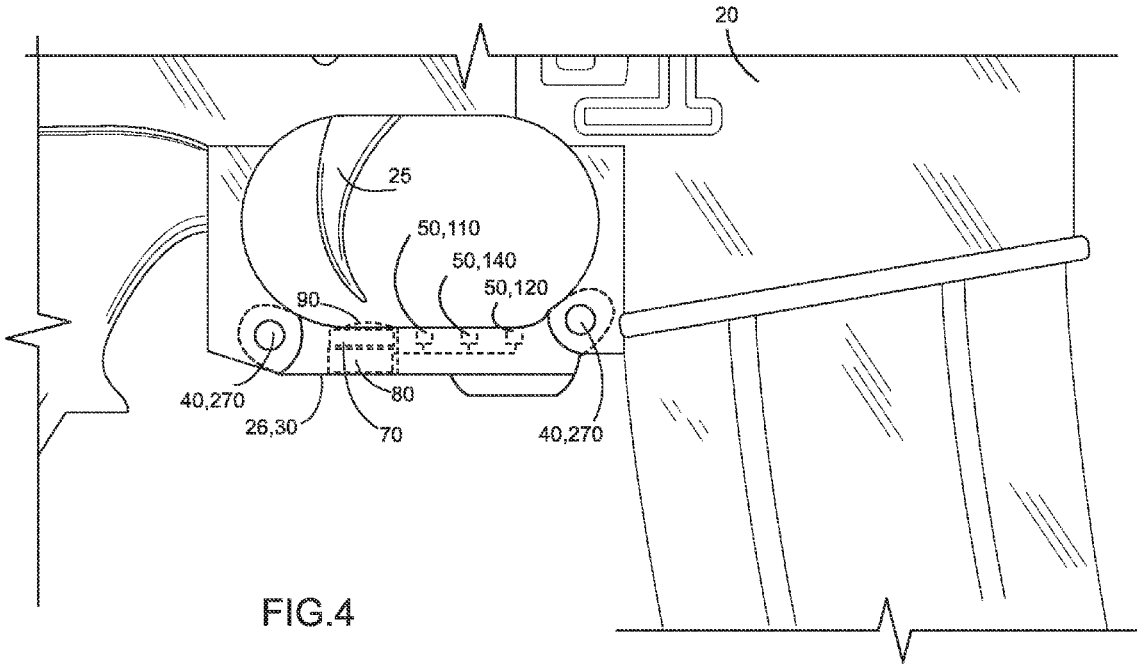
FIG. 4 is a partial right-side elevational view of an embodiment of the invention wherein the proximity alarm of the invention replaces at least a portion of the trigger guard of the firearm.
Figure 5:
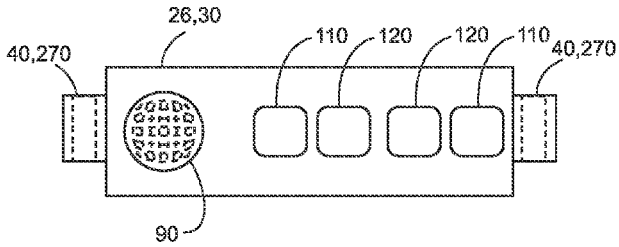
FIG. 5 is a top plan view of the proximity alarm of the embodiment of the invention as illustrated in FIG. 4.
Figure 9:
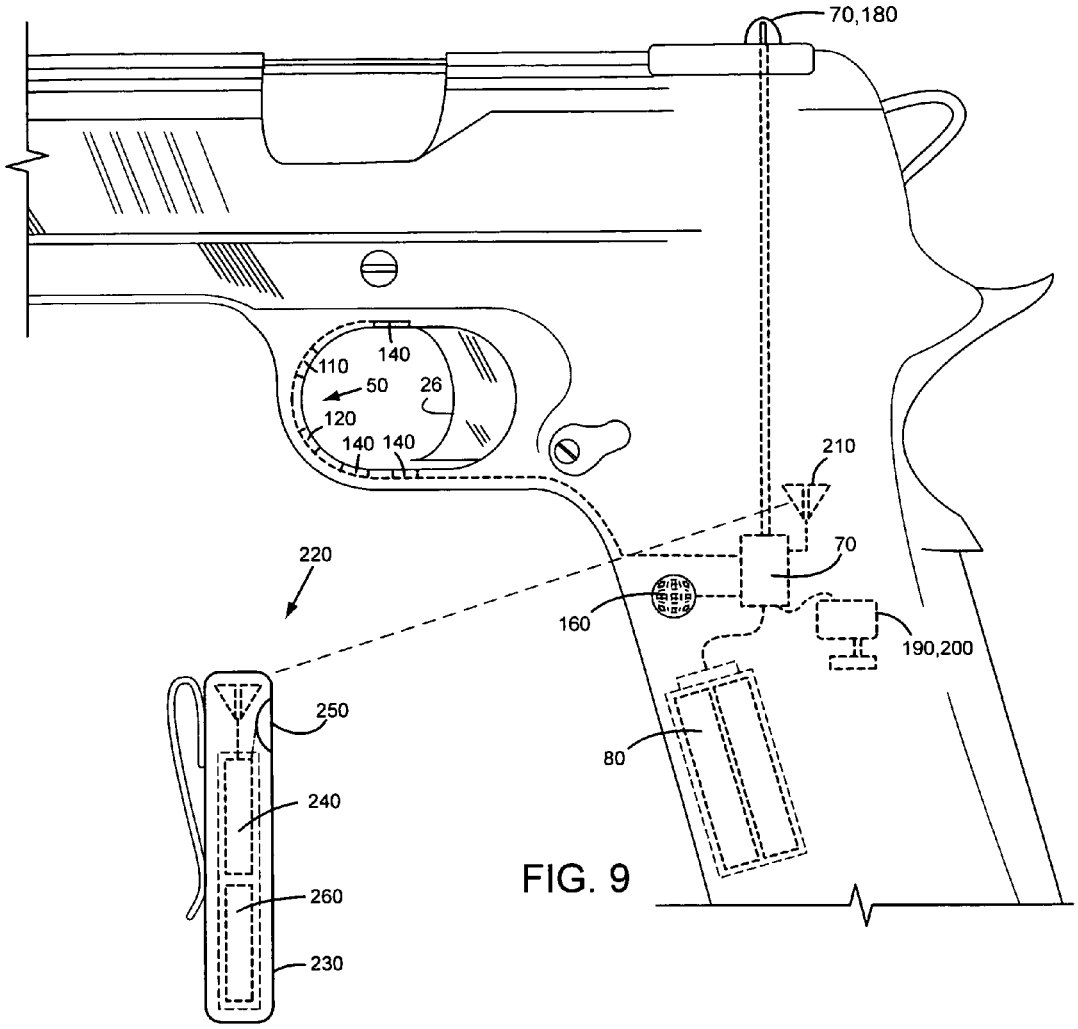
FIG. 9 is a partial right-side elevational view of an embodiment of the invention wherein the proximity alarm of the invention is incorporated into the firearm.

Two preferred main embodiments of the invention are disclosed herein, an embodiment for mounting the proximity alarm 10 onto an existing firearm 20 (FIGS. 1, 4, and 6), and another embodiment wherein the proximity alarm 10 is incorporated into the firearm 20 itself to form a total firearm safety system 300 (FIG. 9). In the first embodiment, the proximity alarm 10 includes an enclosure 30 mounted proximate to the trigger guard 26 of the firearm 20. The enclosure 30 includes a firearm mounting means 40, such as a friction mount (not shown), set screws 45 (FIG. 3), or the like. Clearly the firearm mounting means 40 may be readily adapted for use with various types and structures of firearms 20 without departing from the spirit and scope of the present invention. For example, the mounting means 40 may be adapted for mounting the enclosure 30 to an existing trigger guard with a friction mounting means or clamp (not shown). Alternately, a slotted rail with set screws 45 may be used for mounting the proximity alarm 10 to firearms 20 having an accessories rail 280 (FIGS. 1 and 3), wherein the mounting means 40 comprises an accessory rail mounting means 290 as is known in the art. Or, as shown in FIGS. 4 and 6, the proximity alarm 10 may be incorporated into a removable trigger guard 26 on some firearms such as the M16 series rifles.

In all of the embodiments of the invention, however, the proximity alarm 10 may be mounted to the firearm 20, at least one proximity sensor 50 is fixed substantially within or on the housing 30 or the trigger guard 26, and positioned to detect the object 60 entering between the trigger 25 and the trigger guard 26. Such a proximity sensor 50 may be an optical sensor 100 such as an infrared 110 emitter and a photodiode 120 combination, such as the HSDL-9100 Miniature Surface-Mount Proximity Sensor manufactured by Agilent Technologies, or the like. The photodiode 120 is positioned to receive reflected infrared light 130 from the object 60 when the object 60 enters the space between the trigger 25 and the trigger guard 26.

Alternately, the proximity sensor 50 may be an electrical capacitive sensor 140 (FIGS. 1 and 9), wherein the object 60 by entering between the trigger 25 and the trigger guard 26 detectably changes the electrical capacitance between two elements of the sensor 140. One such element of the sensor 140 may be the trigger 25 itself with the firearm 20 acting as electrical ground. Alternately, the sensor 140 may be electrically isolated from the firearm 20.

Figure 6:
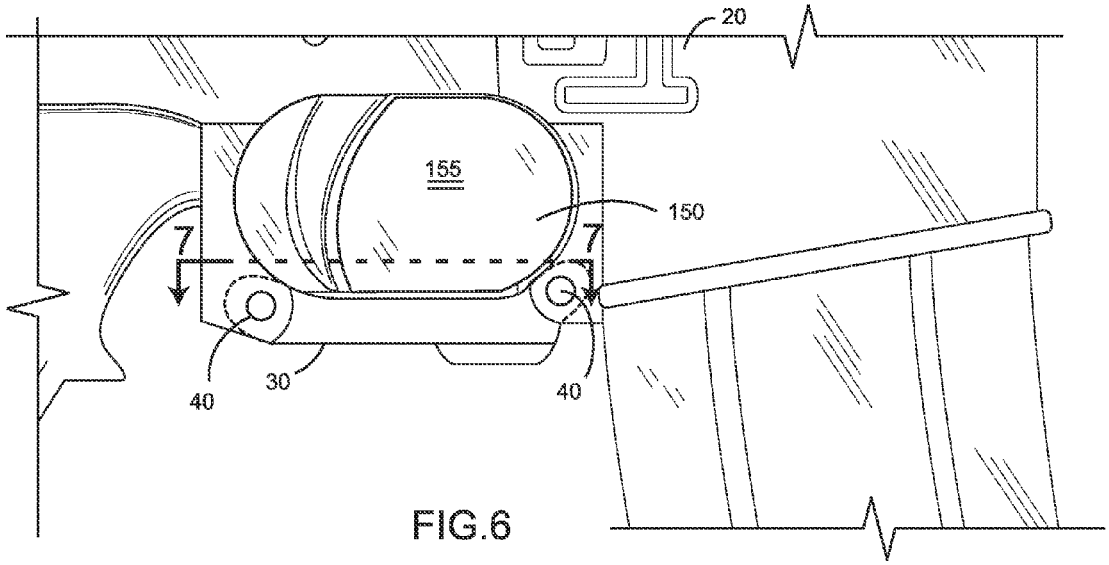
FIG. 6 is a partial right-side elevational view of a firearm and a proximity alarm of the present invention, illustrating an embodiment wherein the proximity alarm includes a mechanical switch.
Figure 7:
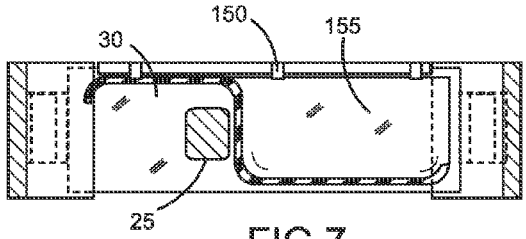
FIG. 7 is a top plan view of the proximity alarm of the embodiment of the invention as illustrated in FIG. 6.
Figure 8:
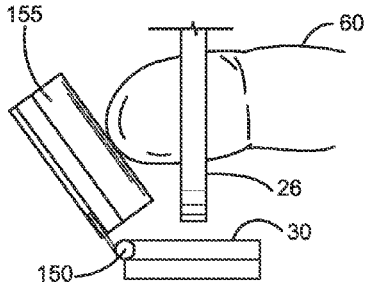
FIG. 8 is a front elevational view of the proximity alarm of the embodiment of the invention as illustrated in FIG. 6, illustrating an object actuating the switch.

In another embodiment of the invention, the proximity sensor 50 may be a mechanical switch 150 (FIGS. 6-8). The switch 50 is positioned so as to be actuated when the object 60 enters the space between the trigger 25 and the trigger guard 26. The switch 150 in its normally closed position includes a plate 155 adapted to substantially fill the space between the trigger 25 and the trigger guard 26.

The proximity alarm 10 further includes an alarm circuit 70 electrically connected to the at least one proximity sensor 50 and housed in the enclosure 30 or, in the embodiment wherein the proximity alarm 10 is incorporated into the firearm 20, within the firearm 20 itself, such as within a grip 23 or frame 22 (FIG. 9). The alarm circuit 70 includes a power source 80, such as a battery, and an alarm means 90, such as an audio alarm 160, a visual alarm 170 such as a flashing warning light 180, or a tactile alarm 190 such as a vibration means 200, which may include a motor and an offset weight, for example, in contact with a user's body and adapted for alerting the user tactilely (FIG. 9). The alarm circuit 70 may include a microprocessor system for interpreting sensor data, determining if an alarm condition exists, and the like.

The alarm means 90 may further include a wireless transmitter 210 that transmits an alarm signal to a remote alarm unit 220 (FIG. 9). The remote alarm unit 220 includes an enclosure 230 housing an alarm signal receiving means 240, a remote alarm means 250, and a power source 260, all electrically connected so as to activate the remote alarm means 250 whenever the remote alarm unit 220 receives the alarm signal from the alarm means 40. Such a remote alarm unit 220 may include a belt clip so as to be worn on a user's belt, as illustrated, or may be incorporated in a user's head's-up display, hearing protection device, wristwatch, or the like.

The remote alarm means 250 may include the audio alarm 160, the visual alarm 170, or the tactile alarm 190. As such, a trainer or other observer may be alerted when the firearm operator has placed his finger on or near the trigger 25. Indeed, the remote alarm unit 220 may distinguish between alarm signals from a plurality of alarm means 40, whereby a trainer may be alerted as to which of his students, for example, is causing an alarm condition. Such a plurality of alarm means 40 include a unit code number or other distinguishing means encoded into the alarm signal transmission.

While a particular form of the invention has been illustrated and described, it will be apparent that various modifications can be made without departing from the spirit and scope of the invention. For example, the exact placement of the sensors and even the types of proximity sensors used may be varied according to methods common in the art. Accordingly, it is not intended that the invention be limited, except as by the appended claims.

What is claimed is:

1. A proximity alarm for a firearm having a trigger and a trigger guard, the proximity alarm comprising:

an enclosure mounted proximate to the trigger guard, the enclosure including a firearm mounting means;

at least one proximity sensor fixed substantially within the housing and positioned to detect an object entering between the trigger and the trigger guard;

an alarm circuit electrically connected to the at least one proximity sensor, the alarm circuit housed in the enclosure and including a power source and an alarm means;

whereby when the object enters between the trigger and the trigger guard, the proximity sensor detects the object, causing the alarm circuit to activate the alarm means to alert the firearm operator and surrounding individuals that the object is located in close proximity to the trigger of the firearm.

2. The proximity alarm of claim 1 wherein the proximity sensor is an optical sensor.

3. The proximity alarm of claim 2 wherein the optical sensor is an infrared emitter and photodiode combination, the photodiode positioned to receive reflected infrared light from the object when the object enters between the trigger and the trigger guard.

4. The proximity alarm of claim 1 wherein the proximity sensor is an electrical capacitive sensor for detecting electrical capacitive changes between the trigger and the trigger guard when the object enters therebetween.

5. The proximity alarm of claim 1 wherein the proximity sensor is a mechanical switch positioned to be actuated when the object enters between the trigger and the trigger guard.

6. The proximity alarm of claim 1 wherein the alarm means is an audio alarm.

7. The proximity alarm of claim 1 wherein the alarm means is a visual alarm.

8. The proximity alarm of claim 7 wherein the visual alarm is a warning light.

9. The proximity alarm of claim 1 wherein the alarm is a tactile alarm.

10. The proximity alarm of claim 9 wherein the tactile alarm is a vibration means attached proximate to a user's body and adapted for alerting the user tactilely.

11. The proximity alarm of claim 1 wherein the alarm means is a wireless transmitter that transmits an alarm signal to a remote alarm unit, the remote alarm unit including an enclosure housing an alarm signal receiving means, a remote alarm means, and a power source all electrically connected so as to activate the remote alarm means whenever the remote alarm unit receives the alarm signal from alarm means.

12. The proximity alarm of claim 11 wherein the alarm means is an audio alarm.

13. The proximity alarm of claim 11 wherein the alarm means is a visual alarm light.

14. The proximity alarm of claim 11 wherein the alarm is a tactile alarm.

15. The proximity alarm of claim 1 wherein the firearm mounting means is a trigger guard mounting means.

16. The proximity alarm of claim 1 wherein the firearm includes an accessory rail proximate the trigger guard and the firearm mounting means is an accessory rail mounting means.

17. A firearm safety system comprising:

a firearm, the firearm including a trigger and a trigger guard;

a proximity alarm, the proximity alarm including at least one proximity sensor fixed substantially within the trigger guard and positioned to detect an object entering between the trigger and the trigger guard;

an alarm circuit electrically connected to the at least one proximity sensor, the alarm circuit housed within the firearm and including a power source and an alarm means;

whereby when the object enters between the trigger and the trigger guard, the proximity sensor detects the object, causing the alarm circuit to activate the alarm means to alert the firearm operator and surrounding individuals that the object is located in close proximity to the trigger of the firearm.

* * * * *